US006079216A

United States Patent [19]

de Marsillac Plunkett et al.

[11] Patent Number: 6,079,216

[45] Date of Patent: Jun. 27, 2000

[54] REFRIGERATOR FOR SECURELY ACCEPTING DELIVERIES

[76] Inventors: Maria Alice de Marsillac Plunkett, 36 E. 69th St., New York, N.Y. 10021; Edward C. Plunkett, Dunsany Castle, Co. Meath, Ireland

[21] Appl. No.: 08/723,936

[22] Filed: Sep. 27, 1996

[30] Foreign Application Priority Data

Sep. 28, 1995 [IE] Ireland ..... S950757

[51] Int. Cl.[7] ..... F25D 23/02

[52] U.S. Cl. ..... 62/56; 62/440; 109/7; 292/DIG. 71; 312/286

[58] Field of Search ..... 312/286, 287; 109/6, 7, 67, 68; 62/259.1, 440, 441, 56; 292/DIG. 25, DIG. 71

[56] References Cited

U.S. PATENT DOCUMENTS 1,469,359 10/1923 Craw ..... 312/286
1,935,130 11/1933 Schauman ..... 312/286
2,584,886 2/1952 Laguzzi ..... 312/287
2,811,405 10/1957 Formoso ..... 312/287
3,128,866 4/1964 Ratowsky ..... 312/286
4,358,171 11/1982 Christen ..... 312/286
4,741,275 5/1988 Lewiner et al. ..... 109/7

*Primary Examiner*—William E. Tapolcai
*Attorney, Agent, or Firm*—R. Neil Sudol; Henry D. Coleman

[57] ABSTRACT

A refrigerator includes a body defining a compartment, a first door on the body for sealably and releasably closing the compartment and a second door on the body substantially opposite the first door for sealably and releasably closing the compartment. Refrigeration componentry is provided for refrigerating the compartment. Elements are attached to the body for mounting the body to a wall. The first door allows access to the compartment from a first side of the wall and the second door allows access to the compartment from a second side of the wall.

17 Claims, 6 Drawing Sheets

REFRIGERATOR FOR SECURELY ACCEPTING DELIVERIES

FIELD OF THE INVENTION

The present invention relates to a refrigerator and use thereof in a building, exemplarily a domestic dwelling. In particular, this invention relates to a refrigerator which allows access to the interior of the refrigerator through the exterior wall of the dwelling.

BACKGROUND OF THE INVENTION

Home delivery of perishable items requiring refrigeration from a store, supermarket, or the like, generally requires that either the owner or tenant of the home be present or the delivery person have unsupervised access to the home. Such inconveniences preclude the use of delivery services by most of the working populace. Additionally, potentially the greatest users of delivery services, the old, infirm or disabled or partially disabled, may be greatly inconvenienced by deliveries or may be unable to meet the delivery person at their door to accept the delivery. The alternative of providing the delivery service with a key or other means of access can be a significant security risk. A much more convenient, secure means for receiving deliveries of perishable goods is desired.

OBJECTS OF THE INVENTION

It is an object of the invention to provide a refrigerator for conveniently and securely receiving deliveries of perishable items requiring refrigeration.

It is an additional object of the invention to provide a refrigerator for conveniently and securely receiving deliveries of perishable items requiring refrigeration without the need for the owner of the dwelling to be present in the building, or if present in the dwelling, without the need for the owner to admit the delivery person into the dwelling.

These and other objects of the invention will be apparent from the descriptions and illustrations herein.

BRIEF DESCRIPTION

A refrigerator according to the invention comprises a body defining a storage compartment, a first door sealably and releasably mounted to the refrigerator body for enabling access to the compartment and a second door likewise sealably and releasably mounted to the body, e.g., substantially opposite the first door, for enabling access to the compartment. Refrigeration componentry is provided for cooling the compartment. Elements are attached to the refrigerator body for mounting the body to a wall of a building. The first door allows access to the compartment from a first side of the wall and the second door allows access to the compartment from a second side of the wall.

Another feature of the invention is an interior divider in the body defining an additional compartment which may serve as a freezer compartment or a room temperature compartment and is accessible via the first and/or second doors. In a further aspect of the invention, the refrigerator also comprises an assembly for preventing the first door and the second door from being simultaneously open. Security locks may be provided for the door to the outside space and, optionally, the door in the inside space.

A refrigeration installation according to the invention comprises a wall defining an opening and having first and second sides and a refrigerator comprising a body defining a compartment, a first door sealably and releasably mounted to the body for enabling access to the compartment, a second door sealably and releasably mounted to the body preferably substantially opposite the first door for enabling access to the compartment, and refrigeration componentry for reducing the temperature of air inside the compartment. The refrigerator sits proximate to the first side of the wall and is mounted to the wall by elements attached to the body of the refrigerator. The first door of the refrigerator allows manual opening and closing of the refrigerator from the first side of wall. The second door of the refrigerator is aligned with the opening in the wall and allows manual opening and closing of the refrigerator from the second side of the wall.

DETAILED DESCRIPTION OF THE INVENTION

Figure 1:
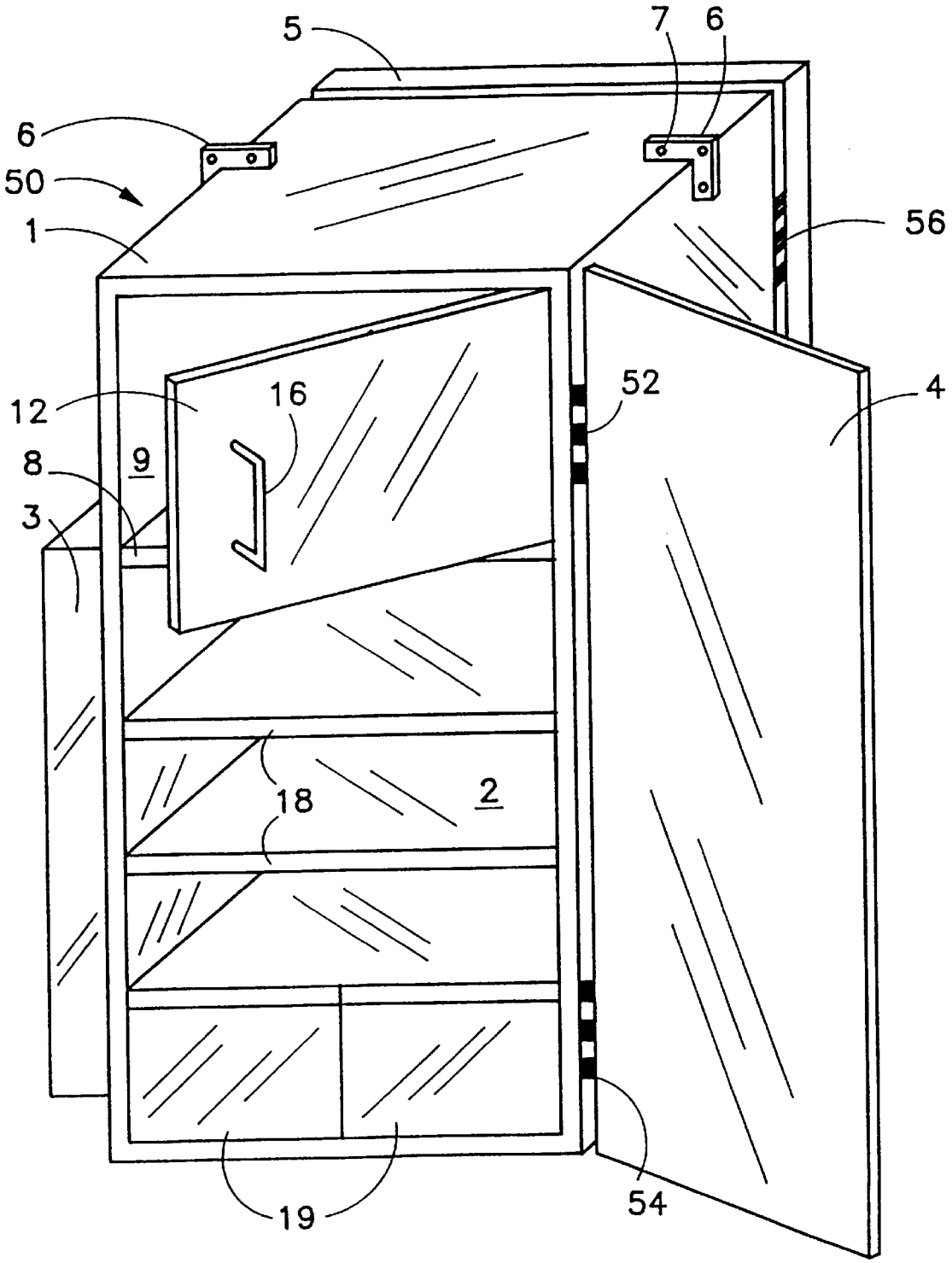
FIG. 1 is a schematic isometric view of a refrigerator according to the invention, showing an inwardly facing door in an open position and an outwardly facing door in a closed position.
Figure 2:
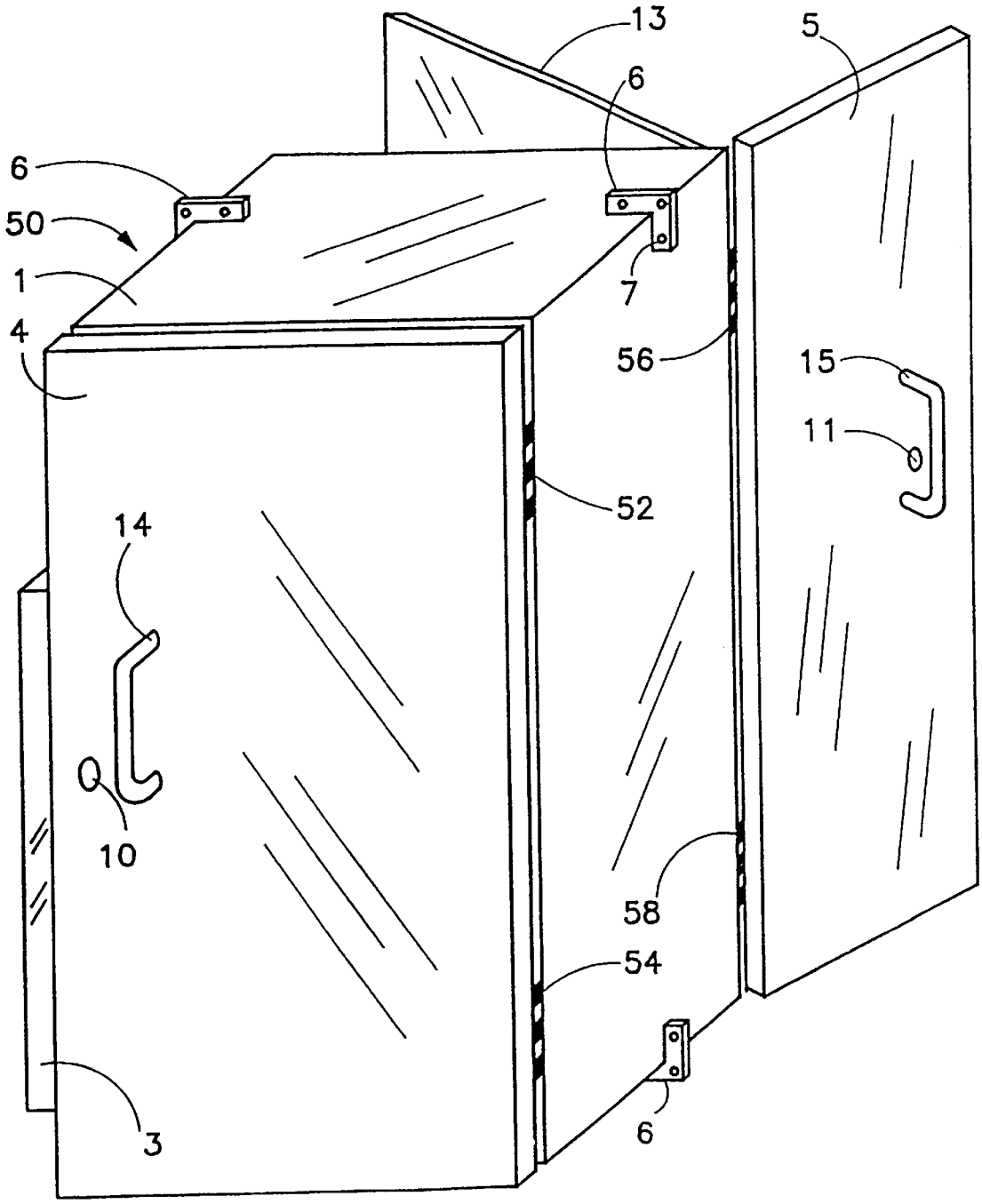
FIG. 2 is a schematic isometric view of the refrigerator of FIG. 1, showing the inwardly facing door in a closed position and the outwardly facing door in an open position.
Figure 4:
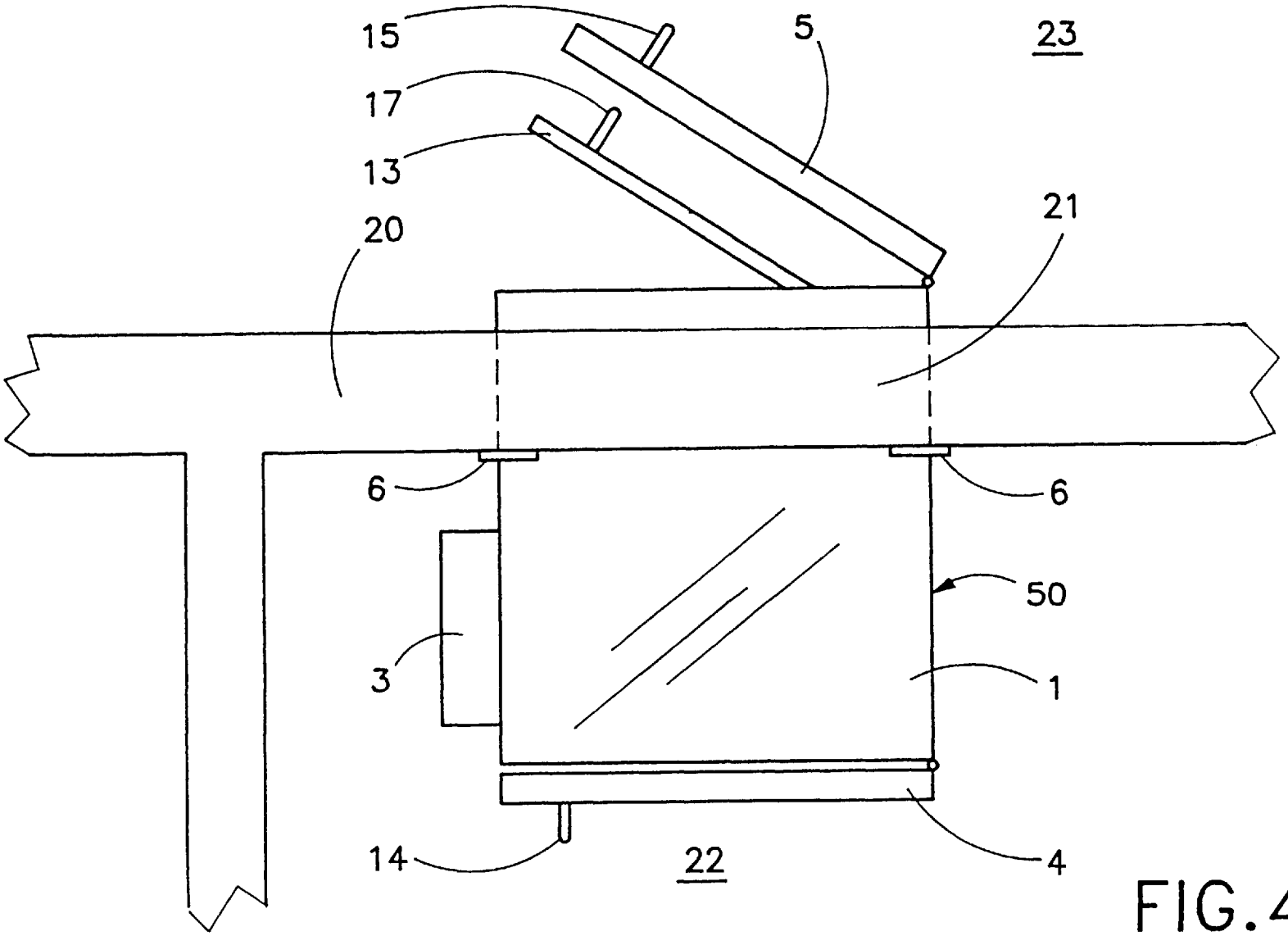
FIG. 4 is a partial plan view of a dwelling with the refrigerator of FIGS. 1 and 2 installed, according to the invention.

FIGS. 1 and 2 illustrate a refrigerator 50 comprising an insulated body 1 which defines a refrigerable compartment 2 for stocking items to be stored under refrigerated conditions. A first sealably and releasably closing door 4 is disposed substantially opposite a second sealably and releasably closing door 5. Both doors provide access to compartment 2 by enabling a user to uncover an opening (not designated) in body 1 which is covered by a respective door 4 and 5. Angles 6 with bolt holes 7 are provided on body 1 for cooperating with bolts (not shown) to secure refrigerator 50 to a wall 20 of a building structure (FIG. 4).

Security dead locks 10 and 11 are provided on doors 4 and 5, respectively, to prevent unauthorized access to the refrigerator or the dwelling via the refrigerator. In addition, as discussed in detail hereinafter with reference to FIG. 3, locks 10 and 11 may be operatively connected so as to permit access to refrigeration compartment 2 through only one door 4 or 5 at any one time.

Refrigeration componentry 3 refrigerates compartment 2 (e.g., to 5° C.) and is preferably located adjacent a side of the refrigerator which does not house a door. Doors 4 and 5 have handles 14 and 15, respectively. Additional refrigerator features known in the art such as shelves 18, crispers 19, automatic ice makers, etc. may also be included.

In one embodiment of the invention, a partition 8 defines an additional compartment 9 inside compartment 2. Compartment 9 is sealably and releasably closed by secondary doors 12 and 13 with handles 16 and 17, respectively. Refrigeration componentry 3 cools compartment 9 to maintain that compartment at freezing temperatures, generally in a range of −18 to −22° C.

In another embodiment of the invention, compartment 2 may also be divided to form a room temperature compartment (not shown) insulated from the rest of the compartment 2 and containing vents allowing free exchange of air between the room temperature compartment and a room in which the refrigerator is disposed.

Door 4 and 5 are attached to body 1 via hinges 52, 54 and 56, 58.

Figure 3:
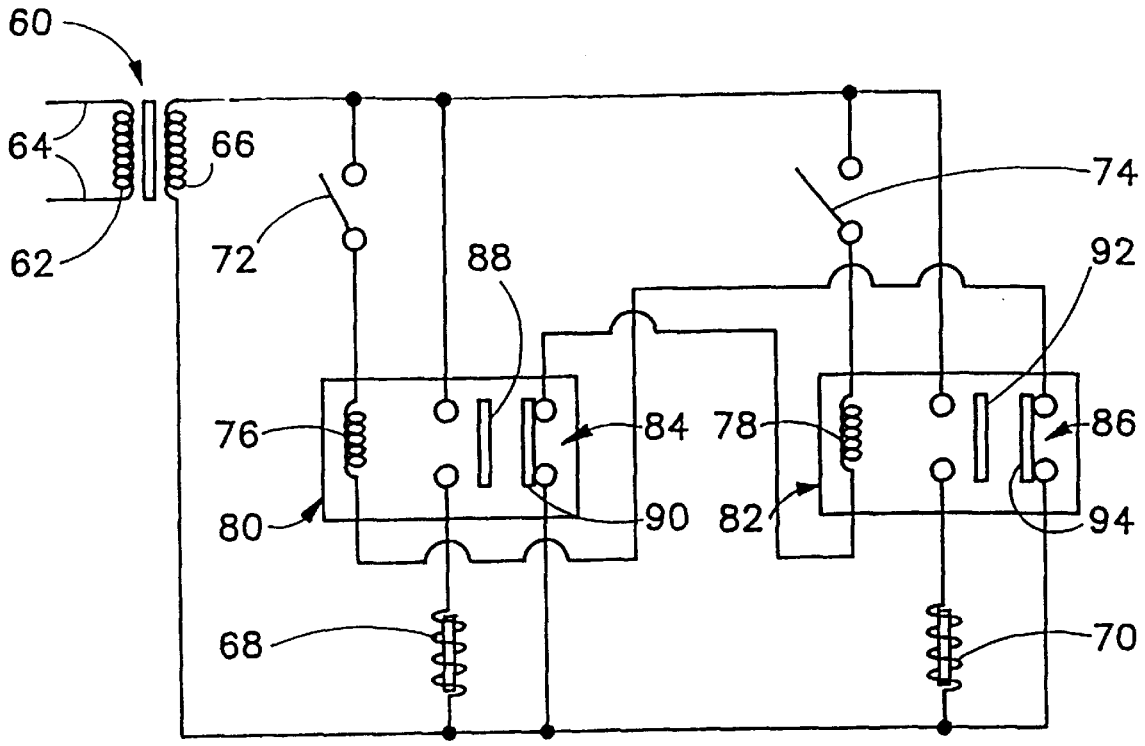
FIG. 3 is a diagram of a circuit for preventing the inwardly and outwardly facing refrigerator doors of FIGS. 1 and 2 from being simultaneously open.

As shown in FIG. 3, a circuit for preventing simultaneous opening of doors 4 and 5 includes a transformer 60 having a primary winding 62 connected to a power line 64 and a secondary winding 66 which energizes one of two spring-biased electromagnetic bolt activators 68 and 70, depending on which one of two switches 72 and 74 is closed first. Switches 72 and 74 are each connected on one side to secondary winding 66 and on another side to a coil 76 or 78 of a respective relay 80 or 82. Current flow through one or the other of coils 76 and 78 trips a respective spring-biased double throw double pole switch 84 or 86 of the respective relay 80 or 82. If coil 76 is energized, contacts 88 and 90 of switch 84 shift to the left in FIG. 3, thereby closing a circuit path through secondary winding 66 and bolt activator 68 and preventing the energization of coil 78 by opening the circuit path through that coil. Similarly, if coil 78 is energized, contacts 92 and 94 of switch 86 shift to the left in FIG. 3, thereby closing a circuit path through secondary winding 66 and bolt activator 70 and preventing the energization of coil 76 by opening the circuit path through that coil.

Locks 10 and 11 (FIGS. 1 and 2) are connected respectively to switches 72 and 74 for selectively closing one or the other of those switches upon turning of a key inside lock 10 or 11. The act of turning a key in one lock 10 or 11 disables the opening of the other door 5 or 4. Preferably, the keys cannot be removed from locks 10 and 11 while the bolts are released. Only after door 4 or 5 has been closed can the key be removed from the respective lock 10 or 11, thereby providing a safeguard against inadvertently leaving the door open.

FIG. 4 illustrates the placement of the refrigerator of FIGS. 1 and 2 in a kitchen 22 or other suitable area of an apartment. Refrigerator body 1 extends through an opening 21 in external wall 20. Secured angles 6 with bolt holes 7 are used to mount body 1 to wall 20. Manual stocking of compartment 2 from a hallway 23 common to a several apartments is performed by, for example, a delivery person from a store, supermarket or the like and occurs through door 5. The occupant of the dwelling removes stock as needed through door 4. Alternatively, areas 22 and 23 may be any two areas of differing security, such as a room in a home and a sidewalk outside the home or a restaurant kitchen and an outer receiving area.

Figure 5:
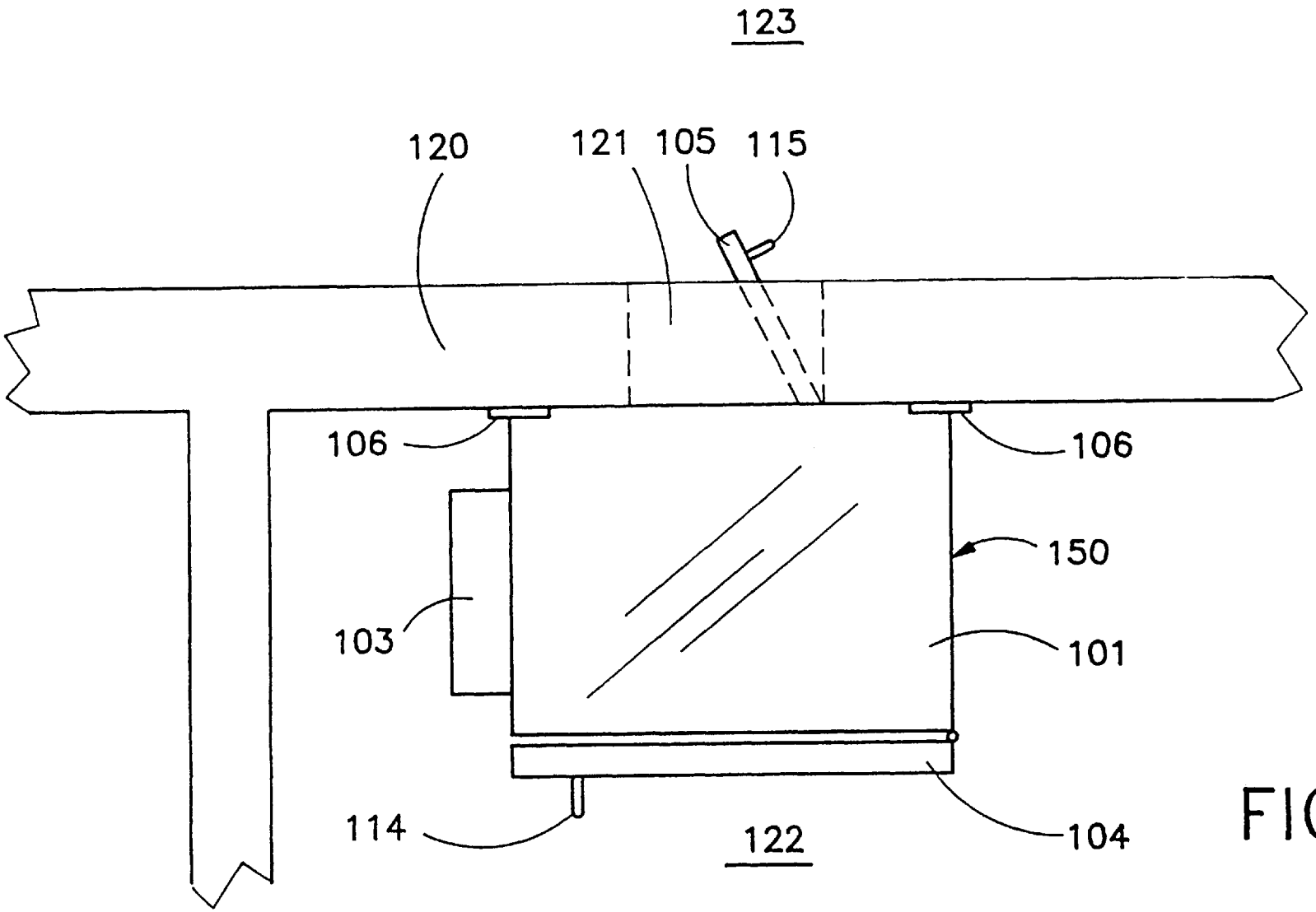
FIG. 5 is a partial plan view of a dwelling with a modified refrigerator installed in a configuration according to the invention.

FIG. 5 illustrates yet another embodiment of the invention in which a refrigerator 150 is adjacent to an inner side of an external wall 120 of the apartment and secured to wall 120 with angles 106 with bolt holes (not shown). A door 104 with a handle 114 provides access from a kitchen 122 to an interior compartment of a refrigerator body 101. The interior compartment is cooled by refrigerating apparatus 103. Refrigerator body 101 covers an opening 121 which is defined by external wall 120 and is substantially smaller than the dimensions of body 101. A door 105 with a handle 115 is aligned with opening 121 and is equal in size to opening 121 or smaller. A delivery person in a public access hallway 123 can reach into opening 121 to open door 105, thereby gaining access to the internal compartment of the refrigerator. Due to its size, door 105 may provide access to only a limited portion of the refrigerable compartment, for example, a subcompartment. The small size of door 105 can also serve as an additional security measure if the door is too small to admit an intruder into the dwelling. For this purpose, door 105 covers an opening (not shown) in body 101 which is smaller than a human being, particularly anybody larger than an infant. Toddlers and other children are blocked from entering the refrigerator, as are adults.

Figure 6:
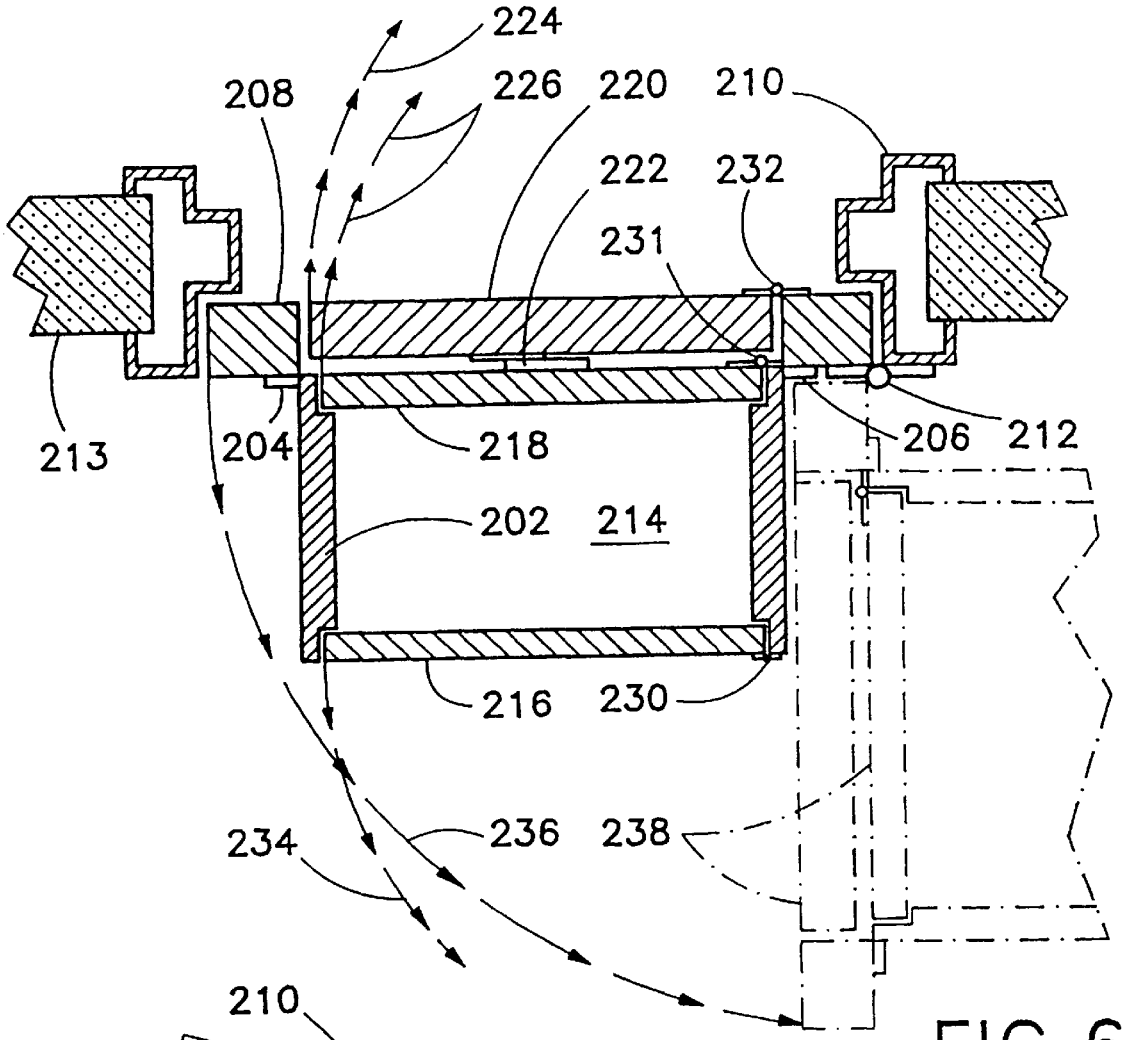
FIG. 6 is a schematic horizontal cross-sectional view, taken along line VI—VI in FIG. 7, of a multiple access refrigerator installed on a door, in accordance with the present invention.
Figure 7:
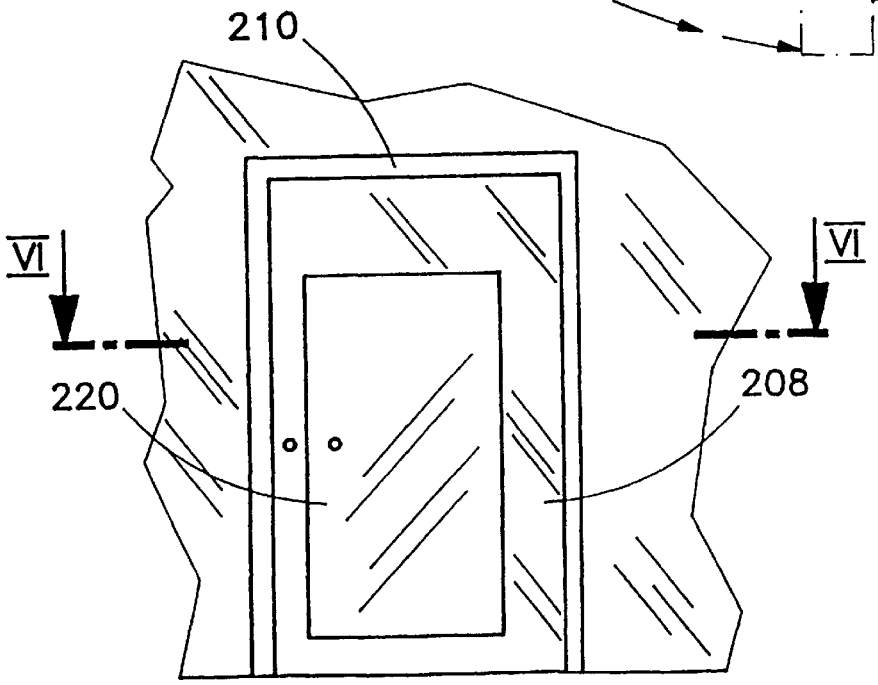
FIG. 7 is a schematic elevational view taken from the top of the page in FIG. 6.

As depicted in FIGS. 6 and 7, a refrigerator body 202 is fastened via brackets 204 and 206 to a metal outer door 208 in turn pivotably attached to a metal door frame 210 via hinges 212. Door frame 210 is disposed in a building wall 213. Refrigerator body 202 has at least one internal compartment 214 which is accessible via opposing insulated front and rear doors 216 and 218 hingedly attached to the refrigerator body. Refrigerator body 202 may be supported at a free side by rollers or coasters (not illustrated) which roll over a floor surface (not shown) of a room in which the refrigerator is disposed. To enable access to compartment 214 from an external space via rear door 218, outer door 208 is provided with a circumscribed auxiliary door 220. Auxiliary door 220 and rear refrigerator door 218 are optionally entrained to one another by a slidable coupling 222 so that the doors pivot in tandem with one another about respective pivot axes, as indicated by arcing arrows 224 and 226.

FIG. 6 depicts external hinges 230 and 231 attaching doors 216 and 218 to refrigerator body 202 and external hinges 212 and 232 fastening door 208 to frame 210 and auxiliary door 220 to door 208. However, it is preferable if these pivoting connections are implemented by internal hinges, as shown in FIG. 8 at 228.

As indicated by arrows 234, front refrigerator door 216 opens into an interior space to provide access to refrigerator compartment 214. As indicated by arrows 236 and phantom lines 238, outer door 208 together with refrigerator body 202 may be pivotably about an axis to maximize access to the interior space through door frame 210. The door locking circuit of FIG. 3 may be used in the refrigerator assembly of FIGS. 6 and 7.

Figure 8:
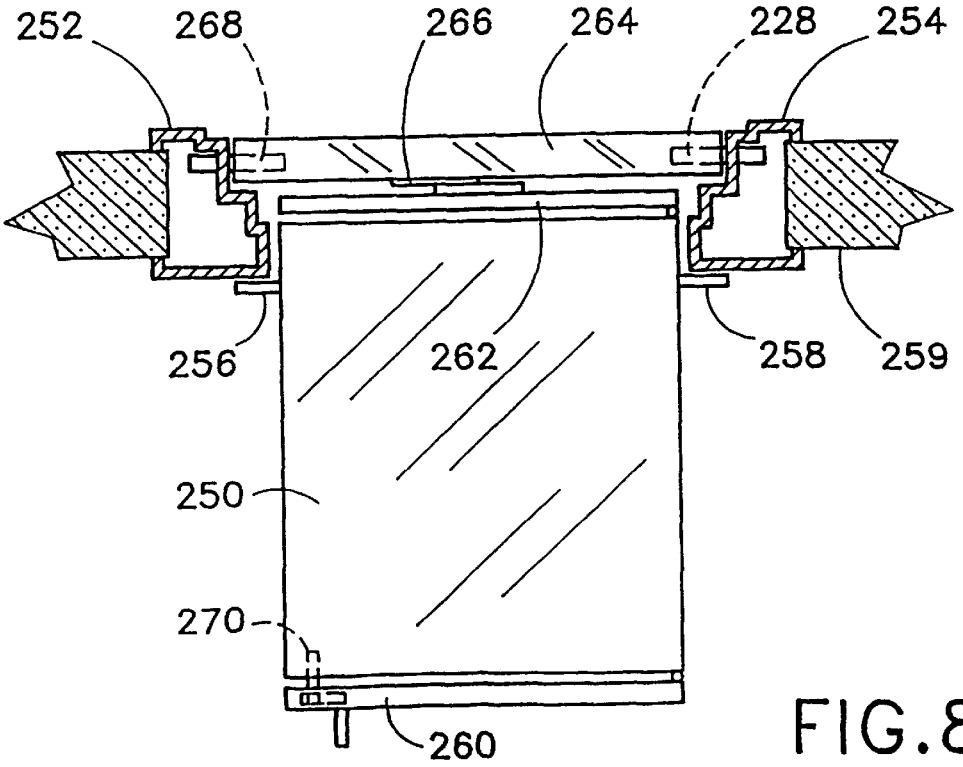
FIG. 8 is partially a schematic cross-sectional view and partially a schematic top or plan view of another refrigerator installation in accordance with the present invention.

FIG. 8 shows a refrigeration installation utilizing a modified version of the refrigerator of FIGS. 1–3. A refrigerator body 250 is inserted between metal door posts 252 and 254 and attached thereto by brackets or angles 256 and 258. Door posts 252 and 254 are coupled to a wall 259 of a building. Refrigerator body 250 has an inwardly facing insulated front door 260 and an outwardly facing insulated rear door 262. Rear door 262 is coupled to a metal outer door 264 via a sliding coupling 266. Outer door 264 is connected to post 254 via internal hinge elements 228 and is releasably locked to post 252 via a slidable bolt 268 which is operated by an electromagnetic actuator as described above with reference to FIG. 3. Similarly, door 260 is locked to body 250 via an electromagnetic bolt activator 270.

Although the invention has been described in terms of particular embodiments and applications, one of ordinary skill in the art, in light of this teaching, can generate additional embodiments and modifications without departing from the spirit of or exceeding the scope of the claimed invention. For example, a refrigerator may have doors on adjacent sides of the refrigerator body, rather than in opposing walls. The locking circuit of FIG. 3 may be provided with more sophisticated components for tracking the opening and closing of the two doors and disabling the outwardly facing door, for instance, if the inwardly facing door has not been opened after access has been obtained through the outer door. Or a programmable timer may be provided for limiting the times that access may be obtained through the outer door. The lock (10) on the inwardly facing door (4) may be omitted, with switch 72 being automatically closed in the event that the door is opened. Thus, a key is necessary to obtain access to the refrigerator only for the outside of the building.

Accordingly, it is to be understood that the drawings and descriptions herein are proffered by way of example to facilitate comprehension of the invention and should not be construed to limit the scope thereof.

What is claimed is:

1. A refrigerator comprising:

a body defining a compartment;

means connected to said body for refrigerating said compartment;

a first door sealably and releasably connected to said body for providing access to said compartment;

a second door sealably and releasably connected to said body for providing access to said compartment;

connectors for mounting said body to a wall, such that said first door allows access to said compartment from a first side of said wall and said second door allows access to said compartment from a second side of said wall; and a locking assembly mounted to said body for preventing said first door and said second door from being simultaneously open.

2. The refrigerator of claim 1 wherein said locking assembly includes a first lock at said first door and said second lock at said second door, the locks being operatively connected to switches for selectively closing one of said switches upon an opening of one of said locks.

3. The refrigerator of claim 1, further comprising an interior divider in said body defining an additional compartment accessible via at least one of said first door and said second door.

4. The refrigerator of claim 3, further comprising means for cooling said additional compartment to temperatures below 0° C.

5. The refrigerator of claim 4, wherein said additional compartment is accessible by both doors.

6. The refrigerator of claim 1 wherein said locking assembly includes means for locking said first door.

7. The refrigerator of claim 6 wherein said locking assembly further includes means for locking said second door.

8. The refrigerator of claim 1, further comprising an interior divider in said body defining an additional compartment accessible via only one of said first door and said second door.

9. A refrigerator comprising:

a body defining a compartment;

means connected to said body for refrigerating said compartment;

a first door sealably and releasably mounted to said body for providing access to said compartment from a first side of said body;

a second door sealably and releasably mounted to said body for providing access to said compartment from a second side of said body; and a locking assembly on said body for preventing said first door from being opened when said second door is open and for preventing said second door from being opened when said first door is open.

10. The refrigerator of claim 9, further comprising an interior divider in said body defining an additional compartment accessible via at least one of said first door and said second door.

11. The refrigerator of claim 10, further comprising means for cooling said additional compartment to temperatures below 0° C.

12. The refrigerator of claim 11, wherein said additional compartment is accessible by said second door.

13. The refrigerator of claim 9 wherein said locking assembly includes means for locking said first door.

14. The refrigerator of claim 13 wherein said locking assembly further includes means for locking said second door.

15. A method for operating a refrigerator, comprising:

opening a first door on one side of a refrigerator body;

upon opening said first door, automatically locking a second door on another side of said refrigerator body different from said first side, thereby preventing the opening of said second door while said first door is open, said first door and said second door both accessing a common compartment in said refrigerator;

closing said first door;

upon closing of said first door, automatically unlocking said second door;

after the closing of said first door and the unlocking of said second door, opening said second door; and upon opening said second door, automatically locking said first door, thereby preventing the opening of said first door while said second door is open.

16. The method of claim 15 wherein the opening of said first door includes unlocking a lock on said first door.

17. The method of claim 16 wherein the openings of said second door includes unlocking a lock on said second door.

* * * * *